US010995433B1

(12) United States Patent
Bergeron et al.

(10) Patent No.: US 10,995,433 B1
(45) Date of Patent: May 4, 2021

(54) CUSTOM FABRIC CASES FOR ELECTRONIC DEVICES

(71) Applicant: Apple Inc., Cupertino, CA (US)

(72) Inventors: Kathleen A. Bergeron, Los Gatos, CA (US); Jessica J. Lu, Mountain View, CA (US); Daniel A. Podhajny, San Jose, CA (US); Daniel D. Sunshine, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 338 days.

(21) Appl. No.: 15/875,388

(22) Filed: Jan. 19, 2018

Related U.S. Application Data

(60) Provisional application No. 62/552,637, filed on Aug. 31, 2017.

(51) Int. Cl.
*D04B 7/26* (2006.01)
*D04B 7/24* (2006.01)
(Continued)

(52) U.S. Cl.
CPC ..... *D04B 7/26* (2013.01); *A41H 3/007* (2013.01); *D04B 7/24* (2013.01); *D04B 15/66* (2013.01);
(Continued)

(58) Field of Classification Search
CPC . D04B 37/02; D04B 7/26; D04B 7/24; D04B 15/66; D04B 37/00; G06F 19/00; G05B 2219/45194
See application file for complete search history.

(56) References Cited

U.S. PATENT DOCUMENTS 4,078,253 A * 3/1978 Kajiura ..... D03C 19/005 358/524
4,514,995 A * 5/1985 Curtis ..... A47G 23/03 66/170

(Continued)

FOREIGN PATENT DOCUMENTS

GB 436055 * 10/1935
JP 10256779 A * 3/1997

OTHER PUBLICATIONS

De Jong, Chevron Phone Cosy Knitting Pattern Tutorial, (Jun. 2013), https://miss-minoes.blogspot.com/2013/06/chevron-phone-cosy-knitting-pattern.html, p. 1 & 5.*

*Primary Examiner* — Danny Worrell
(74) *Attorney, Agent, or Firm* — Treyz Law Group, P.C.; Kendall W. Abbasi

(57) ABSTRACT

A fabric case for an electronic device may include a back panel having a periphery and a side wall that extends around the periphery. The back panel may include a knit image of a user-selected digital photograph or other design. The design of the back panel may be customized according to the user's tastes. The case may be formed using computing equipment and knitting equipment. The computing equipment may receive a digital image from the user and may reduce the resolution and the number of colors in the digital image according to the specifications of the textile machine. Fabric pattern design software may convert the digital image into knitting instructions. The knitting instructions may be executed by knitting equipment to produce a custom back panel having a knit image of the digital photograph. The back panel may be attached to a peripheral side wall to form the fabric case.

19 Claims, 10 Drawing Sheets

(51) Int. Cl.

| | |
|---|---|
| ***A41H 3/00*** | (2006.01) |
| ***D04B 37/00*** | (2006.01) |
| ***D04B 15/66*** | (2006.01) |
| *D05B 19/08* | (2006.01) |
| *A45C 11/00* | (2006.01) |

(52) U.S. Cl.
CPC ..... *D04B 37/00* (2013.01); *A45C 2011/001* (2013.01); *A45C 2011/002* (2013.01); *D05B 19/08* (2013.01)

(56) References Cited

U.S. PATENT DOCUMENTS 5,557,527 A * 9/1996 Kotaki ..... D04B 15/66 66/232
5,719,777 A * 2/1998 Kotaki ..... D04B 37/02 66/75.2
6,185,475 B1 * 2/2001 Chung ..... G06T 11/001 139/11
6,611,730 B1 * 8/2003 Stoll ..... D04B 37/02 700/131
6,880,367 B2 * 4/2005 Suzuki ..... D04B 37/02 66/232
6,895,787 B2 * 5/2005 Maeiwa ..... D04B 1/106 66/232
8,545,966 B2 10/2013 Vito et al.
8,726,701 B2 * 5/2014 Habert ..... D04B 1/26 66/232
8,844,763 B1 * 9/2014 Momirov ..... B65D 33/28 150/154
8,958,902 B2 * 2/2015 Levine ..... D04B 1/26 700/141
9,124,680 B2 9/2015 Lundell
9,877,605 B2 * 1/2018 Clark ..... A47G 19/2288
2004/0065380 A1 * 4/2004 Speich ..... D03C 19/005 139/383 R
2005/0161352 A1 * 7/2005 Huddleston ..... A45C 11/00 206/320
2005/0255898 A1 * 11/2005 Huang ..... H04B 1/3877 455/575.8
2007/0156276 A1 * 7/2007 Smedley ..... D04B 37/02 700/141
2011/0282476 A1 11/2011 Hegemier et al.
2012/0194982 A1 8/2012 Hishida
2013/0092562 A1 4/2013 Wyner et al.
2014/0189927 A1 * 7/2014 Kidman ..... A41D 27/205 2/69
2015/0151515 A1 6/2015 Skepton
2018/0159968 A1 * 6/2018 Cai ..... H04B 1/3888

* cited by examiner

CUSTOM FABRIC CASES FOR ELECTRONIC DEVICES

This application claims the benefit of provisional patent application No. 62/552,637, filed Aug. 31, 2017, which is hereby incorporated by reference herein in its entirety.

FIELD

This relates generally to fabric, and, more particularly, to forming fabric for structures such as cases for electronic devices.

BACKGROUND

Electronic devices such as cellular telephones, computers, and other electronic equipment are sometimes used in conjunction with external cases. A user may, for example, place an electronic device in a removable plastic case to protect the electronic device from scratches. Removable cases may also be used to personalize electronic devices.

Plastic cases may be satisfactory in certain situations, but some users may desire a case with different aesthetics. As a result, fabric cases have been developed.

There are challenges associated with forming fabric cases for electronic devices. A user may have limited choices when it comes to selecting a fabric case for his or her device. The user may be able to select a desired color, but may otherwise be unable to customize a fabric case according to the user's preferences.

SUMMARY

A fabric case for an electronic device may include a back panel having a periphery and a side wall that extends around the periphery. The back panel and the side wall may be joined monolithically or may be joined using seams.

The back panel may include a knit image of a digital photograph or other design. The design of the back panel may be customized according to the designer's tastes. The designer may be a user of the case or electronic device, or the designer may be a manufacturer of the case or electronic device.

The case may be designed and constructed using computing equipment and knitting equipment. The computing equipment may receive a user-selected digital image from the user. The computing equipment may use image processing software to reduce the resolution and the number of colors in the digital image according to the specifications of the textile machine.

Fabric pattern design software may convert the digital image into knitting instructions. The knitting instructions may be executed by knitting equipment to produce a back panel for a fabric case. The back panel may have a knit image of the digital photograph. The back panel may include rows and columns of knitted loops of colored yarn. Each loop may form a pixel in the knit image. The knit image may be located on an exterior surface of the fabric case. The back panel may be attached to a peripheral side wall to form a recess that receives the electronic device.

DETAILED DESCRIPTION

Electronic devices may be provided with cases such as fabric cases. The fabric cases may be removable external cases. When a user desires to protect an electronic device from scratches or other damage, the user may place an electronic device within a case. When the user wishes to use a different case to change the appearance of an electronic device, the electronic device may be transferred from one case to another. If desired, fabric may be incorporated into an electronic device housing or may be used in forming other fabric-based structures. Arrangements in which fabric is used in forming removable external cases are sometimes described herein as an example.

The fabric for a removable case may be woven, knitted (e.g., weft knitted or warp knitted), or braided, or may be formed using other strand intertwining techniques. For example, fabric can be knit using a knitting machine.

Figure 1:
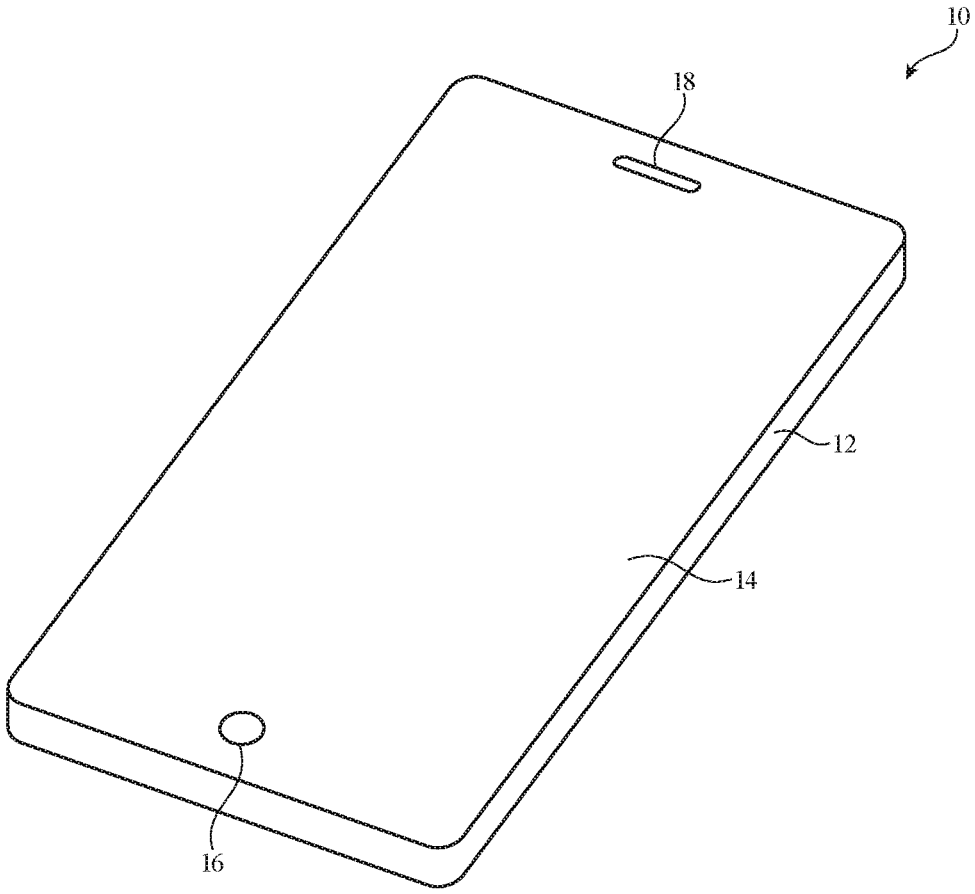
FIG. 1 is a perspective view of an illustrative electronic device in accordance with an embodiment.

An electronic device of the type that may be provided with a removable case that has been formed using intertwined strands is shown in FIG. 1. In the example of FIG. 1, device 10 includes a display such as display 14 mounted in housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Display 14 may include an array of pixels formed from liquid crystal display (LCD) components, an array of electrophoretic pixels, an array of plasma pixels, an array of organic light-emitting diode pixels or other light-emitting diodes, an array of electrowetting pixels, or pixels based on other display technologies.

Display 14 may be protected using a display cover layer such as a layer of transparent glass or clear plastic. The display cover layer may form a planar front face for device 10. The rear of housing 12 may have a parallel planar surface. Housing side walls may run around the periphery of housing 12. Device 10 may have a rectangular outline (e.g., a rectangular footprint when viewing the front face of the device) or may have other suitable footprints.

Openings may be formed in the display cover layer. For example, an opening may be formed in the display cover layer to accommodate a button such as button 16. An opening may also be formed in the display cover layer to accommodate ports such as speaker port 18. Openings may be formed in housing 12 to form communications ports (e.g., an audio jack port, a digital data port, etc.), to form openings for buttons, etc.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

Figure 2:
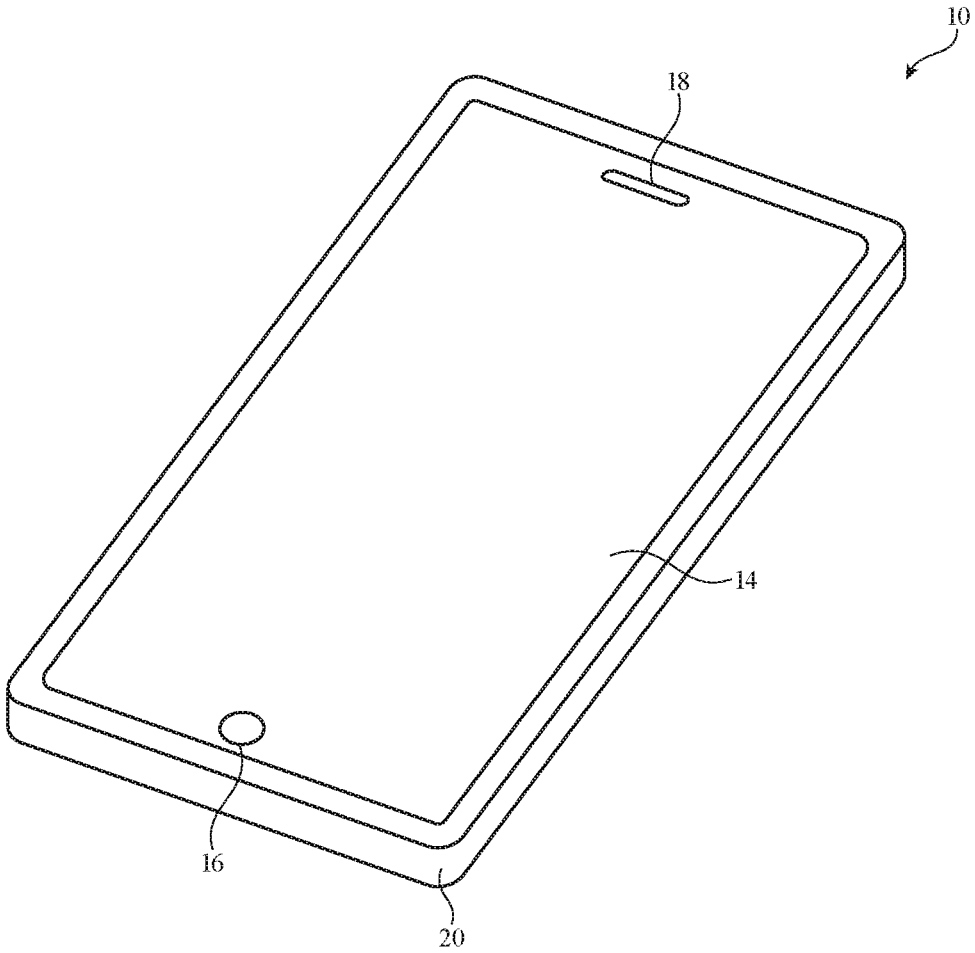
FIG. 2 is a perspective view of an illustrative electronic device to which a removable case has been attached in accordance with an embodiment.

FIG. 2 is a perspective view of device 10 of FIG. 1 in a configuration in which device 10 has been mounted in a removable case. As shown in FIG. 2, removable case 20 may have walls that run around the periphery of device 10. If desired, case 20 may form a cover with a hinged portion, a structure with a pocket into which device 10 may slide, or other enclosure that receives device 10. In the example of FIG. 2, case 20 surrounds device 10, but does not cover display 14. This type of arrangement, which may be desirable for devices such as cellular telephones, watches, and tablet computers, allows display 14 to be viewed by a user without opening a cover flap or moving any portion of case 20. If desired, however, case 20 may be provided with pockets, flaps, hinged portions, straps, and other structures. The configuration of FIG. 2 is merely illustrative.

Figure 3:
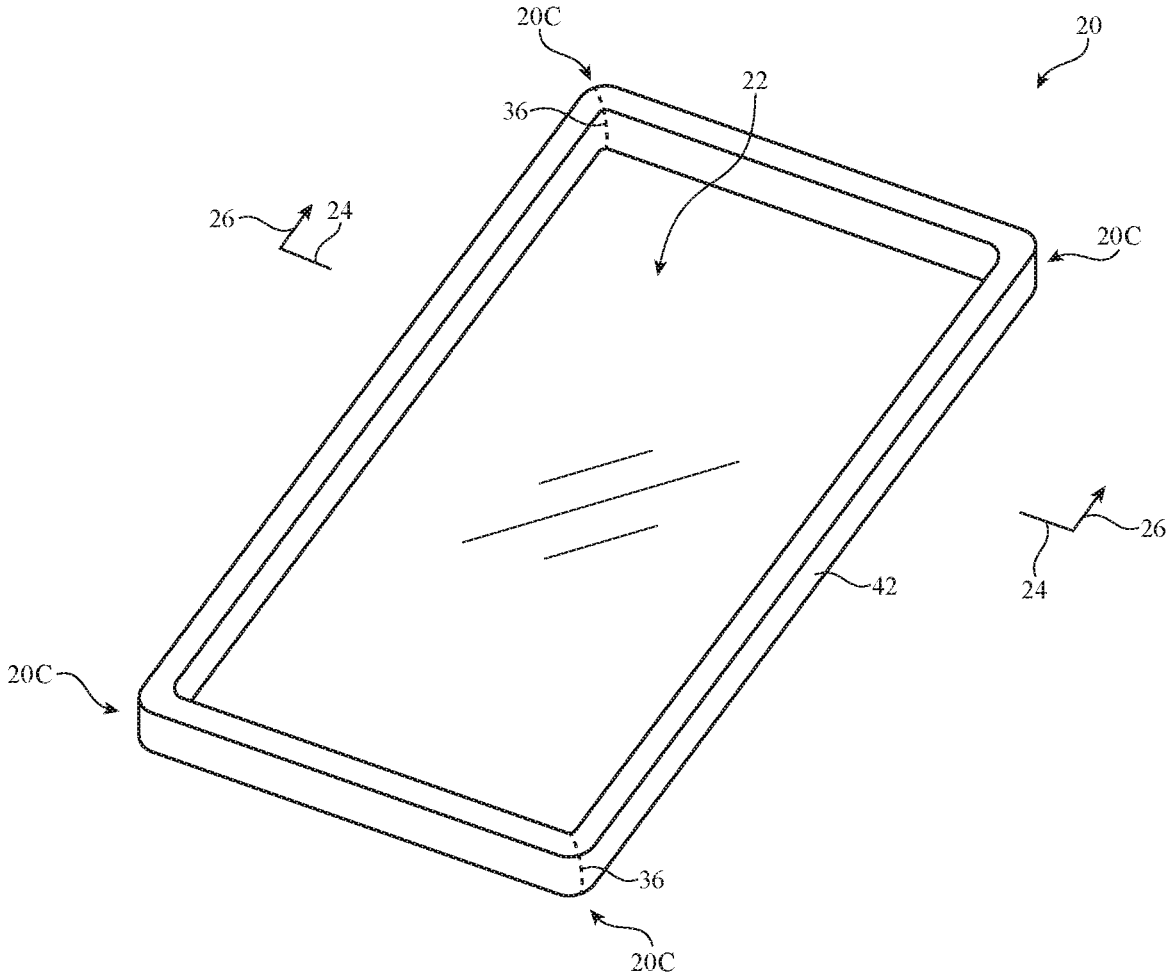
FIG. 3 is s perspective view of an illustrative removable electronic device case in accordance with an embodiment.

FIG. 3 is a perspective view of case 20 of FIG. 2 in a configuration in which device 10 is not present (i.e., a configuration in which case 20 has been removed from device 10). As shown in FIG. 3, case 20 may have four straight segments each of which runs along and covers a respective one of the four straight peripheral edges of the rectangular housing of device 10. Corner portions of the case join the straight segments together to form a case with a rectangular ring shape. Corners 20C may be rounded when viewed from above (i.e., when case 20 has a footprint with rounded corners) or may have other shapes. Central opening 22 may have a rectangular shape (e.g., a rectangular shape with rounded corners) or other shape suitable for receiving electronic device 10 when electronic device 10 is mounted within case 20.

Case 20 may have one or more portions formed from fabric 42. Fabric 42 may be soft (e.g., case 20 may have a fabric surface that yields to a light touch), may have a rigid feel (e.g., the surface of case 20 may be formed from a stiff fabric), may be coarse, may be smooth, may have ribs or other patterned textures, and/or may be formed as part of a device that has portions formed from non-fabric structures of plastic, metal, glass, crystalline materials, ceramics, or other materials.

The strands of material in fabric 42 may be single-filament strands (sometimes referred to as fibers or monofilaments), may be yarns or other strands that have been formed by intertwining multiple filaments (multiple monofilaments) of material together, or may be other types of strands (e.g., tubing). Monofilaments for fabric 42 may include polymer monofilaments and/or other insulating monofilaments and/or may include bare wires and/or insulated wires. Monofilaments formed from polymer cores with metal coatings and monofilaments formed from three or more layers (cores, intermediate layers, and one or more outer layers each of which may be insulating and/or conductive) may also be used.

Yarns in fabric 42 may be formed from polymer, metal, glass, graphite, ceramic, natural materials as cotton or bamboo, or other organic and/or inorganic materials and combinations of these materials. Conductive coatings such as metal coatings may be formed on non-conductive material. For example, plastic yarns and monofilaments in fabric 42 may be coated with metal to make them conductive. Reflective coatings such as metal coatings may be applied to make yarns and monofilaments reflective. Yarns may be formed from a bundle of bare metal wires or metal wire intertwined with insulating monofilaments (as examples). Yarns in fabric 42 may be any suitable color (e.g., red, orange, yellow, green, blue, indigo, violet, gray, black, white, different shades of these colors, a mix of two or more of these colors, etc.).

Strands of material may be intertwined to form fabric 42 using intertwining equipment such as weaving equipment, knitting equipment, or braiding equipment. Intertwined strands may, for example, form woven fabric, knit fabric, braided fabric, etc.

Figure 4:
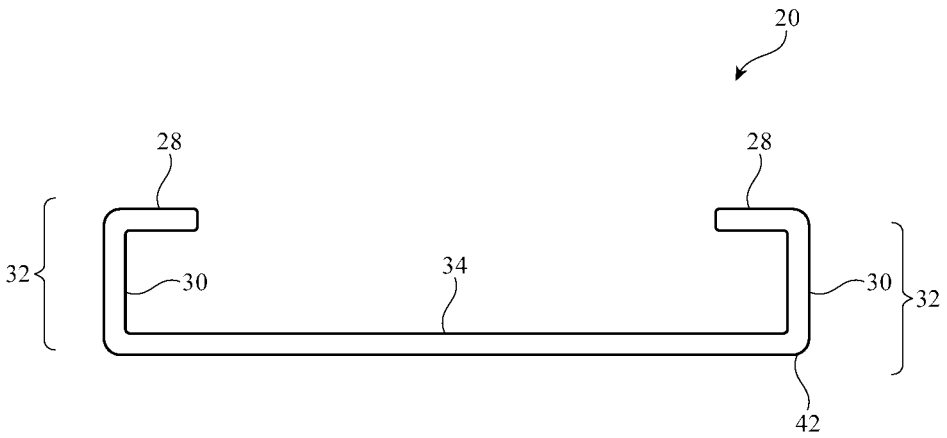
FIG. 4 is a cross-sectional view of a removable case with peripheral walls monolithically formed with a back panel in accordance with an embodiment.

A cross-sectional view of case 20 of FIG. 3 taken along line 24 and viewed in direction 26 is shown in FIG. 4. As shown in FIG. 4, case 20 may have peripheral portions such as peripheral wall portions 32 and a rear wall portion such as back panel 34. Back panel 34 may cover the rear side of electronic device 10 when device 10 is within case 20. Peripheral walls 32 may include vertical side walls 30 that join respective upper horizontal wall portion 28. Peripheral walls 32 may extend around the periphery of device 10 when device 10 is installed within case 20. The cross-sectional shape of case 20 of FIG. 4 (i.e., the shape in which horizontal walls 28 are perpendicular to vertical walls 30) is merely illustrative. If, for example, device 10 has edges with a curved cross-sectional shape, the profile of peripheral walls 32 may have a corresponding curved shape (e.g., side wall 30 may bow outwards). In some arrangements, horizontal portion 28 of walls 32 may be omitted. If desired, the fabric of case 20 may be formed from strands that are elastic to accommodate and/or conform to devices 10 with a variety of different edge profiles and footprints. The example of FIGS. 3, 4, and 5 is merely illustrative.

Back panel portion 34 may be formed from a layer of plastic or metal or may be formed from a layer of fabric. Rear portion 34 may cover some or all of the rear of device 10 and may be attached to portions 32 or woven or formed as an integral portion of portions 32. In the example of FIG. 4, peripheral walls 32 and back panel 34 are formed from fabrics that are joined monolithically (e.g., without joints or seams).

Figure 5:
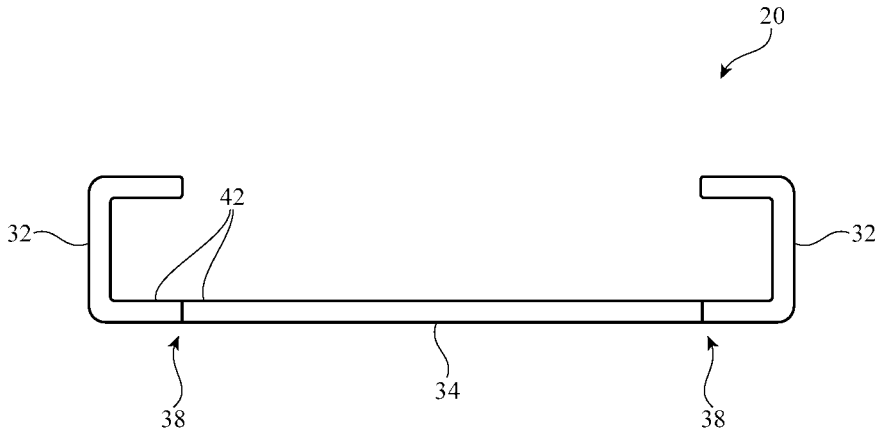
FIG. 5 is a cross-sectional view of a removable case with peripheral walls that are attached to a back panel with seams in accordance with an embodiment.

FIG. 5 is a cross-sectional side view of an illustrative case 20 in which peripheral walls 32 and back panel 34 are formed from fabrics that are joined using seams such as seam 38. Seam 38 may be a chain stitch formed using a linking strand, or may be any other suitable type of stitch, seam, or attachment member. When peripheral walls 32 and back panel 34 are formed separately and then subsequently joined, different methods and techniques may be employed in the formation of each piece, if desired. For example, peripheral walls 32 may be flat knit single layer structure, a warp knit fabric, a weft knit fabric, a seamless tube of fabric, one or more strips of fabric that are joined to form a rectangular outline, a spacer fabric, or other suitable fabric type. Back panel 34 may be a flat knit structure, a warp knit structure, a weft knit structure, a spacer fabric, one or more strips of fabric that are joined to form a panel, or other suitable fabric type.

Some or all of fabric 42 of case 20 may include a custom design. The custom design may, for example, be an image, pattern, or other design. The image may be formed using different colors of yarn. The yarn may be knit or woven in such a way as to create the desired image or pattern on case 20. For example, case 20 may include an image of a person, a landscape, a car, or any other suitable object or scene, and/or may include patterns, shapes, or other design elements. The custom design portion may, for example, be located on rear panel 34 or may be located on other portions of case 20. The design may face the exterior of case 20 so that the design is visible even when device 10 is located in case 20. The image may comprised of "pixels," where each pixel is formed by one or more loops or stitches of fabric 42.

Figure 6:
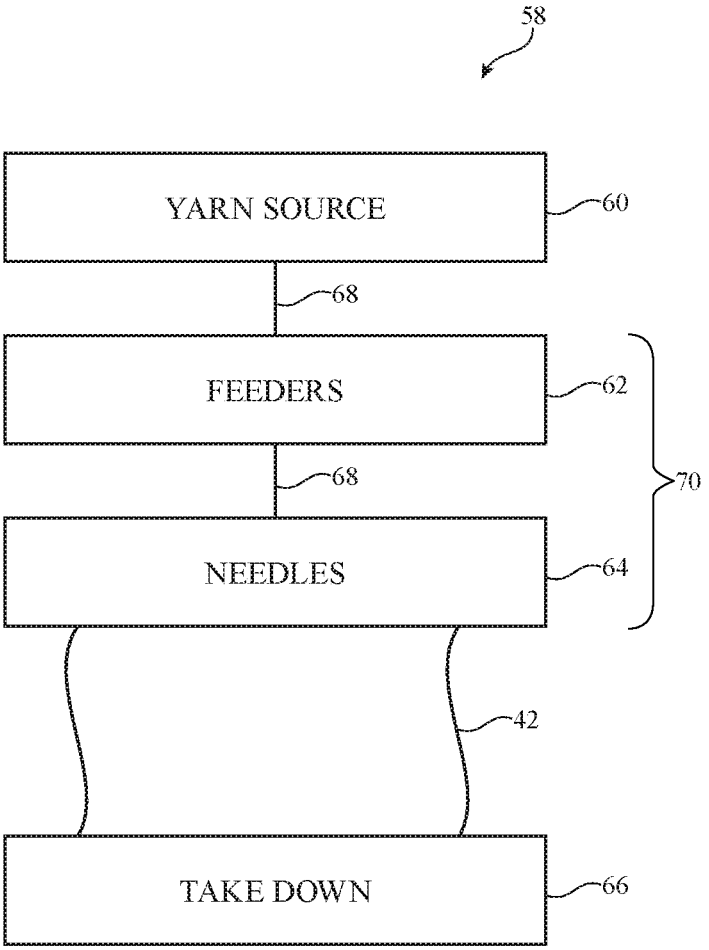
FIG. 6 is a diagram of an illustrative knitting system in accordance with an embodiment.

Knitted fabric such as knitted fabric 42 of FIGS. 3, 4, and 5 may be formed using any suitable knitting equipment. An illustrative knitting system for forming fabric 42 (e.g., fabric having a user-selected image) is shown in FIG. 6. As shown in FIG. 6, knitting equipment such as knitting system 58 may include a yarn source such as yarn source 60. Yarn source 60 may include a creel with spools of yarn 68. Knitting elements 70 may be used to knit yarn 68 into knitted fabric 42. Knitted fabric 42 may be gathered on drums or other take-down equipment 66.

Knitting elements 70 may include yarn guide structures such as feeders 62 that guide yarn 68 towards needles and other equipment 64. Equipment 64 may include latch needles or needles of other types. In some arrangements, equipment 64 may include multiple beds of needles such as a front needle bed and a back needle bed. Equipment 64 may include yarn positioning structures that move yarn 68 from one bed to another bed. Equipment 64 may also include hooks or other cam structures and other structures for manipulating the positions of needles. The needles, feeders, and other knitting elements 70 may be implemented as separately adjustable components or the functionality of two or more of these tools may be combined in equipment 64. Equipment such as feeders 62 and needles 64 (i.e., knitting elements 70) may sometimes be referred to as knitting equipment.

The use of a knitting system such as knitting system 58 of FIG. 6 to knit fabric 42 is sometimes described herein as an illustrative example. Other techniques for forming fabric 42 may be used, if desired. For example, a weaving machine may be used in arrangements where some or all of fabric 42 is woven fabric. In general any suitable textile machine may be used to form fabric 42 (e.g., a knitting machine, a weaving machine, a braiding machine, a dial linking machine, etc.).

Knitting system 58 or other suitable strand intertwining equipment may be used to create custom fabric cases for electronic devices. Custom fabric cases may include color images, patterns, or other designs. Knitting system 58 may receive data from a knitting program that instructs knitting system 58 how to knit the fabric to achieve the desired design. If, for example, a designer (e.g., a user, the case manufacturer, or a third party) wanted a photograph of a landscape on the fabric case, fabric pattern design software may be used to convert the photograph into a textile machine file. The textile machine file may be loaded onto control circuitry that operates knitting system 58 (e.g., that supplies control signals to knitting system 58 based on the textile machine file) or the textile machine file could be provided to a technician who operates knitting system 58 according to the textile machine file instructions. When knitting system 58 knits fabric 42 according to the textile machine file instructions, fabric 42 may have an image of the user-selected photograph. In some arrangements, the image on fabric 42 may have a lower resolution and fewer colors than the original user-selected photograph.

Figure 7:
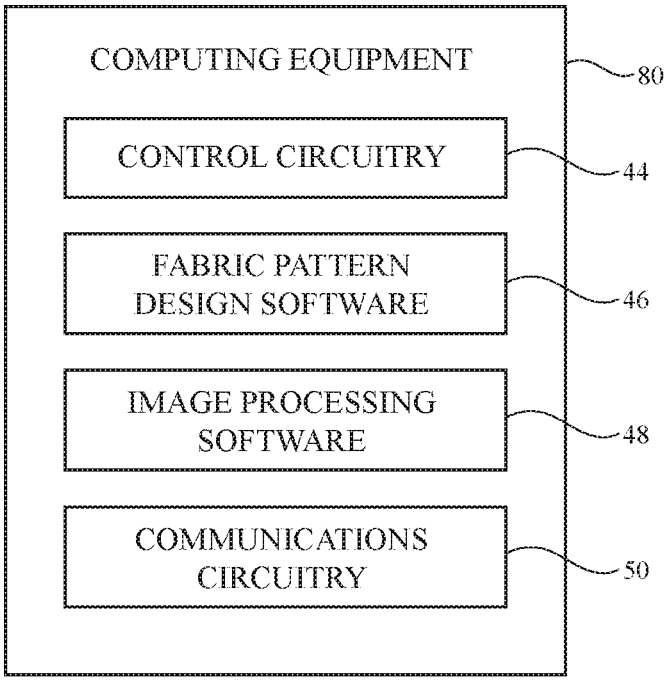
FIG. 7 is a schematic diagram of illustrative computing equipment that may be used to convert images to customized fabric patterns in accordance with an embodiment.

Illustrative computing equipment that may be used to convert image files into a textile machine file for knitting system 58 is shown in FIG. 7. As shown in FIG. 7, computing equipment 80 may include control circuitry 44. Control circuitry 44 may include processing circuitry such as one or more microprocessors, microcontrollers, digital signal processors, application-specific integrated circuits, and other processors and may include storage such as random access memory, flash storage (e.g., flash disk drives), hard disk drives, and other memory. Control circuitry 44 may run software such as fabric pattern design software 46 and image processing software 48.

Fabric pattern design software 46 may be used to convert image files into a textile machine file. The textile machine file may be provided to knitting equipment 58, and knitting equipment 58 may knit fabric 42 based on the textile machine file received from computing equipment 80. In some arrangements, the textile machine file may be computer code that is loaded onto the control circuitry of knitting equipment 58 and that instructs the control circuitry how to operate the textile machine to produce the desired pattern. In other arrangements, the textile machine file may be a knitting pattern (e.g., a knitting chart) that is readable by a technician operating the textile machine, who is then able to operate the textile machine according to the knitting pattern instructions. In either case, the resulting fabric (e.g., fabric 42) may have a knit version of the electronic image file. This fabric may be used in forming case 20.

Image processing circuitry 48 may be used to process images before the images are converted into a textile machine file by fabric pattern design software 46. Image processing circuitry 48 may be used to adjust the resolution, colors, brightness, size, content, or other characteristic of an image before it is converted into a textile machine file. For example, if an image is high resolution and has more colors than the textile machine can produce, image processing circuitry 48 may be used to reduce the resolution of the image and reduce the number of colors in the image to match the capabilities of knitting equipment 58. If desired, some or all of the functionality of image processing software 48 may be implemented using fabric pattern design software 46. For example, the resolution, colors, brightness, size, or content of an image may be adjusted before the image is converted into a textile machine file, or any of these characteristics may be adjusted after the image is converted into a textile machine file.

Communications circuitry 50 may be used to transmit information from computing equipment 80 to knitting equipment 58 and/or to external equipment and/or may be used to receive information from knitting equipment 50 or external equipment. For example, a textile machine file produced by fabric pattern design software 46 may be supplied from computing equipment 80 to knitting system 58. Communications circuitry 50 may also be used to gather information from knitting system 58 such as machine specifications (e.g., the textile machine make and model, the gauge of the textile machine, the diameter or width of the textile machine, the number of feeders, the number of yarn colors, the number of needles etc.). If desired, machine specifications may be provided to computing equipment manually (e.g., by a technician operating computing equipment 80 and/or knitting equipment 58). The example in which machine specifications are gathered using communications circuitry 50 is merely illustrative. Communications circuitry 50 may also be used to gather image data (e.g., user-selected photographs or other custom designs) to be converted into a textile machine file.

Communications circuitry 50 may include antennas and wireless local area network transceiver circuitry (e.g., WiFi® circuitry), Bluetooth® transceiver circuitry, cellular telephone transceiver circuitry, other radio-frequency transceiver circuitry (e.g., circuitry operating in bands from 700 MHz to 2700 MHz, below 700 MHz, above 2700 MHz, or other suitable wireless communications frequencies).

Figure 8:
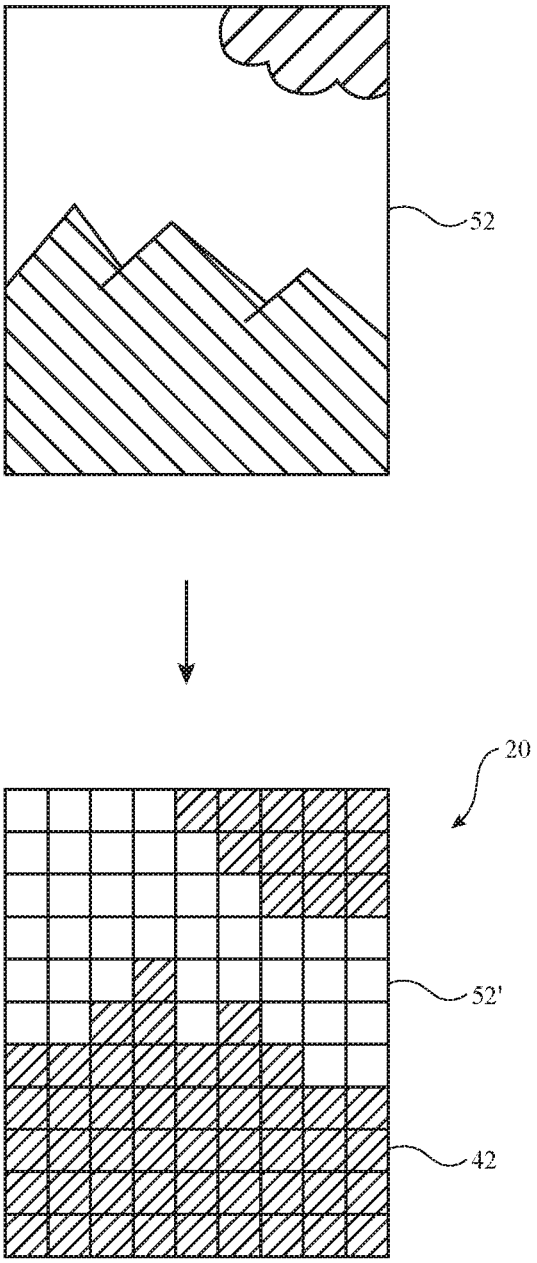
FIG. 8 is a diagram showing how a customized fabric case may be created from a picture in accordance with an embodiment.

FIG. 8 is a diagram showing how an image file may be reproduced on a fabric case. Image 52 may be a digital image file such as a Tagged Image File Format (TIFF) file, a bitmap (BMP) file, a Joint Photographic Experts Group (JPEG) file, a Photoshop® (PSD) file, a portable networks graphics (PNG) file, a Graphics Interchange Format (GIF) file, or other suitable digital image file. Digital image 52 may be a photograph (e.g., a digital photograph taken and/or selected by a user of case 20 and device 10, by a manufacturer of case 20 and/or device 10, or by a third party), may be a pattern with different shapes and colors, may be a combination of a photograph and other designs, or may be other suitable image.

Image 52 may be provided to computing equipment 80 (FIG. 7). Computing equipment 80 may use image processing software 48 to adjust one or more characteristics of image 52 (e.g., to reduce the resolution of image 52, reduce the number of colors in image 52, or make other suitable adjustments to image 52). Fabric pattern design software 46 may be used to convert the image into a textile machine file. The textile machine file may be provided to knitting equipment 58. Knitting equipment 58 may then be used to knit fabric 42 with image 52'. Image 52' may be a knit version of the original image 52. Image 52' may, if desired, be located on back panel 34 of case 20 and may face the exterior of case 20.

Figure 9:
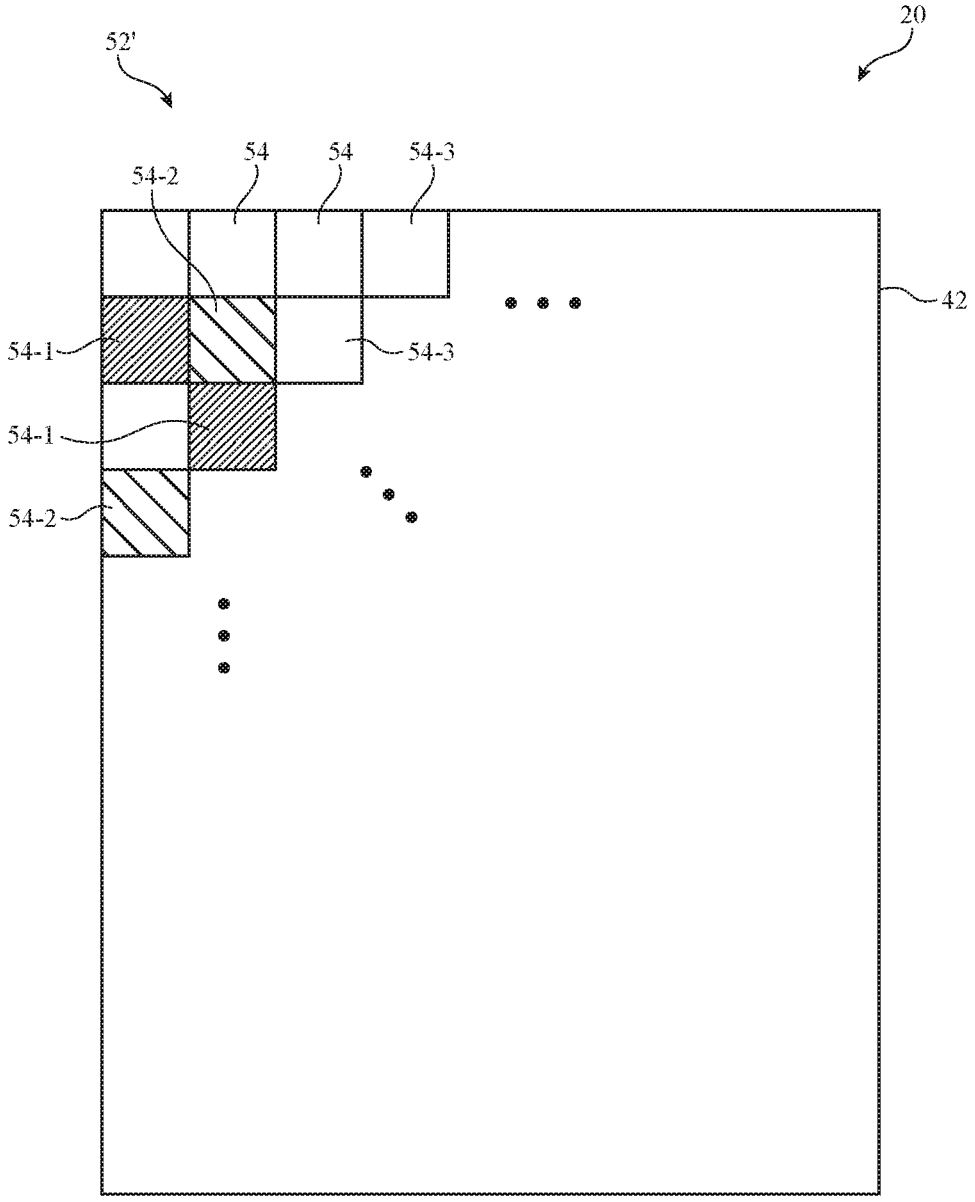
FIG. 9 is a top view of an illustrative fabric case having a rows and columns of pixels for forming images in accordance with an embodiment.

FIG. 9 is a top view of case 20 showing how image 52' may be created on case 20 by forming different regions of case 20 with different colors. Fabric 42 of case 20 may be made up of an array of pixels such as pixels 54. Each pixel 54 may be a point of color. There may be one, two, four, six, twelve, more than twelve, or less than twelve colors that make up image 52' on fabric 42. Each pixel 54 may have one of the possible colors that make up image 52'. For example, pixels 54-1 may be a first color, pixels 54-2 may be a second color, and pixels 54-3 may be a third color. The color of each pixel may be selected to create the desired image 52'. Knitting equipment 58 may be used to knit fabric 42 so that yarns 68 of the appropriate color are placed at each pixel 54.

There may be any suitable number of pixels 54 in image 52' on fabric 42. In one suitable arrangement, image 52' on fabric 42 has 120 rows and 64 columns of pixels 54 (e.g., 120×64 resolution). This is, however, merely illustrative. Arrangements in which the resolution of image 52' is greater or less than 120 pixels by 64 pixels may also be used.

Figure 10:
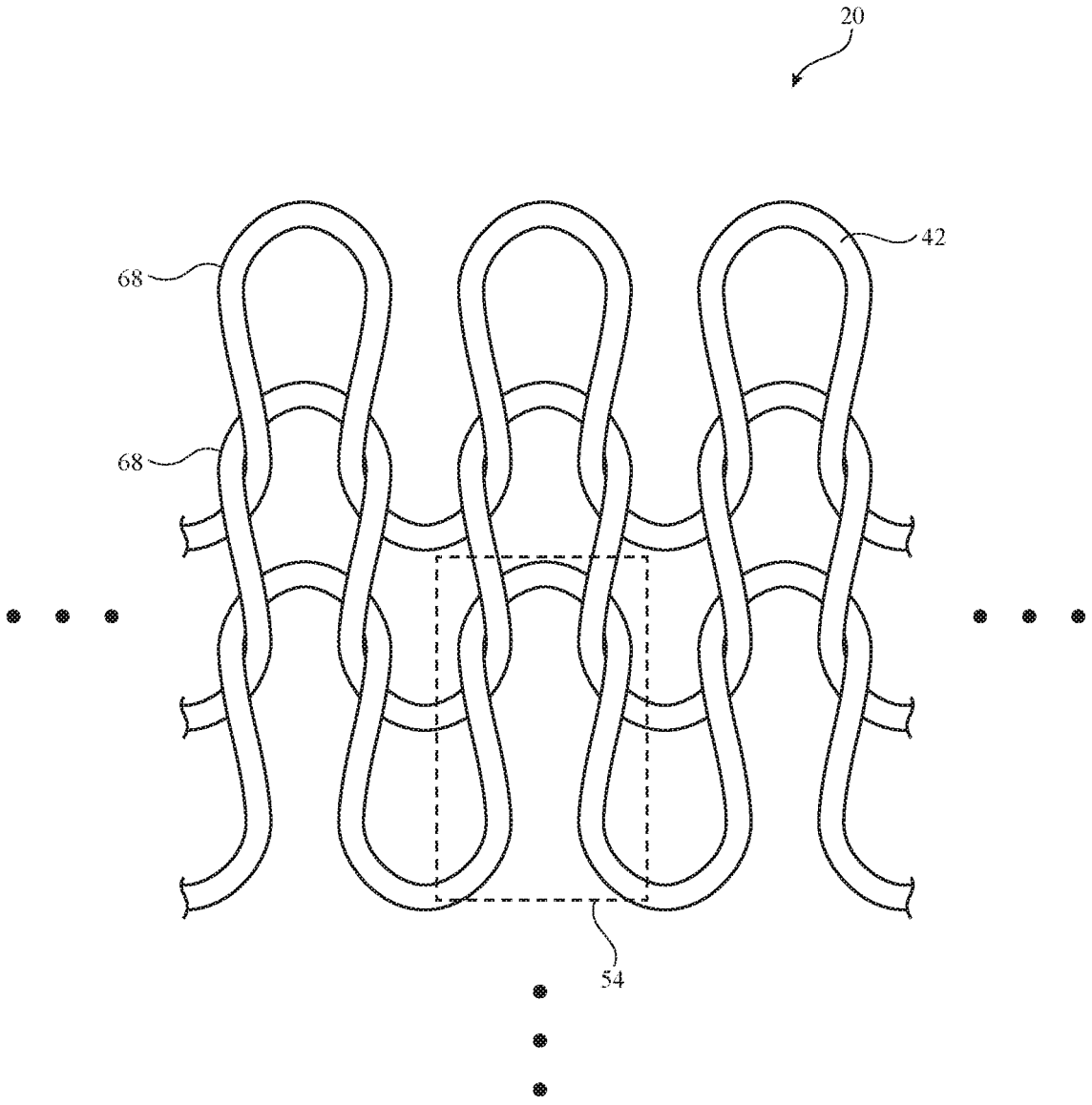
FIG. 10 is a top view of an illustrative knit fabric that may be used to form the fabric case of FIG. 9 in accordance with an embodiment.

FIG. 10 shows how fabric 42 may be comprised of knitted yarn 68. Each pixel 54 may be formed from one or more loops or stitches in fabric 42. In the example of FIG. 10, each pixel 54 is formed from one loop in fabric 42. This is, however, merely illustrative. If desired, each pixel 54 may be formed from two or more adjacent loops in fabric 42 (e.g., two, four, six, or other suitable number of loops in fabric 42).

Figure 11:
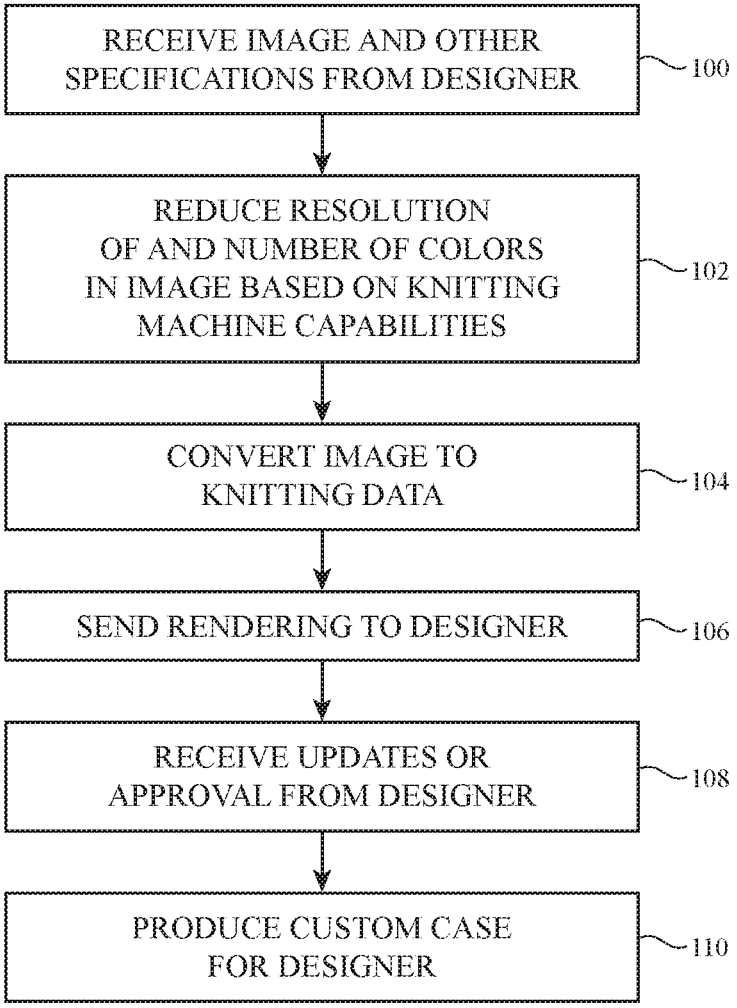
FIG. 11 is a flow chart of illustrative steps involved in forming a customized fabric case for a user in accordance with an embodiment.

The design of case 20 (e.g., back panel 34 of case 20) may be customized by a designer. The designer may be a user of case 20 and/or device 10, the designer may be a manufacturer of case 20 and/or device 10, or the designer may be a third party. FIG. 11 is a flow chart of illustrative steps involved in producing a custom case 20 for a designer.

At step 100, computing equipment 80 may receive an image such as image 52 from the designer. Image 52 may be a photograph (e.g., taken with a camera), may be a computer-generated image, may be a pattern of different shapes and colors, or may have any other suitable design. If desired, the designer may request other custom-characteristics for case 20. For example, the designer may specify the fabric construction (e.g., warp knit, flat knit, woven, etc.), the type of yarn or material in case 20, the amount of friction on case 20 (e.g., whether one or more sides of case 20 should have more friction to enhance landscape or portrait orientation viewing), the amount and placement of drop protection features (e.g., whether corners of case 20 should be more drop-resistant than sides of case 20), the elasticity of one or more portions of case 20, the softness or feel of case 20, the amount of transparency or translucency in portions of case 20, any additional materials to be incorporated into case 20 (e.g., leather, cashmere, silk, plastic, etc.), or other suitable specifications.

At optional step 102, computing equipment 80 may use image processing software 48 to make adjustments to image 52 according to the capabilities of knitting equipment 58 and according to the desired characteristics of case 20 (e.g., the size, shape, or other characteristic of case 20). For example, a 21-gauge textile machine (e.g., having 21 needles per inch) may be able to produce a higher resolution image than an 18-gauge textile machine (e.g., having 18 needles per inch). If image 52 is a high-resolution image having a large number of colors, and if knitting equipment 58 is capable of forming fabrics with six colors and 120 pixels by 64 pixels resolution, then image processing software 48 may reduce the resolution of image 52 to 120 pixels by 64 pixels, and may reduce the number of colors in image 52 to six. If image 52 already has the appropriate resolution and number of colors, then step 102 may be omitted.

At step 104, computing equipment 80 may use fabric pattern design software 46 to convert image 52 (e.g., the adjusted version of image 52 having the appropriate resolution and number of colors for knitting equipment 58) into a textile machine file. The textile machine file may be a set of knitting instructions that indicate the order of knitting, the type of stitch, the transfer rows, and other suitable knitting information that results in fabric 42 having the desired image 52' when the knitting instructions are followed. The textile machine file may be a file of computer code that is loaded onto knitting equipment 58 and executed automatically (e.g., using computer-generated control signals to instruct knitting equipment 58 to follow the textile machine file instructions), or the textile machine file may be a graphical representation of the knitting instructions (e.g., a knitting chart) that allows a technician to manually operate knitting equipment 58 according to the textile machine file instructions.

At step 106, computing equipment 80 may generate a rendering of the finished case 20 with image 52' for review by the designer. The rendering may be a two-dimensional rendering of back panel 34 having the desired image 52', or the rendering may be a three-dimensional rendering of case 20 having the desired image 52'. This allows the designer to review and approve the proposed design and, if desired, make changes (e.g., changes to the colors, content, tone, material, size, and/or other characteristic).

At step 108, computing equipment 80 may receive the updates or an approval from the designer. If the designer approves the rendering, processing may proceed without any changes to the textile machine file. If the designer makes changes, computing equipment 80 may make the appropriate updates to the textile machine file (e.g., using fabric pattern design software 46 and/or image processing software 48). The review portion of the process is merely illustrative. If desired, steps 106 and 108 may be omitted.

At step 110, knitting equipment 58 may be used to create fabric 42 with image 52' using the textile machine file generated by computing equipment 80. This may include loading the textile machine file onto control circuitry that controls knitting equipment 58 so that knitting equipment 58 automatically knits according to the textile machine file, or this may include providing a knitting chart to a technician so that the technician can manually operate knitting equipment 58 according to the textile machine file. In both cases, the resulting fabric will be such that yarns 68 of the appropriate color are placed at each pixel 54 to produce the desired image 52' on fabric 42. In arrangements where image 52' is formed on back panel 34, back panel 34 may be joined (e.g., joined monolithically or joined with seams) to side walls 32 to form a finished case 20 (as shown in FIGS. 3, 4, and 5). Image 52' may, if desired, be located on the external surface of back panel 34 of case 20 (e.g., the surface that faces away from device 10 when device 10 is located in case 20).

The foregoing is merely illustrative and various modifications can be made by those skilled in the art without departing from the scope and spirit of the described embodiments. The foregoing embodiments may be implemented individually or in any combination.

What is claimed is:

1. A method for forming a fabric case for an electronic device having a display, comprising:

with computing equipment, receiving a user-selected digital image;

with the computing equipment, converting the user-selected digital image into knitting instructions;

with knitting equipment, knitting a back panel for the fabric case with colored yarns according to the knitting instructions, wherein the back panel has four sides; and attaching a peripheral side wall to all of the four sides of the back panel, wherein the peripheral side wall is configured to extend around an outer perimeter of the electronic device without covering the display.

2. The method defined in claim 1, wherein the back panel comprises a knit representation of the user-selected digital image.

3. The method defined in claim 2, wherein the colored yarns are arranged in rows and columns of loops, and wherein each loop forms a pixel in the knit representation of the user-selected digital image.

4. The method defined in claim 2, wherein the back panel has a periphery and wherein the peripheral side wall surrounds the periphery.

5. The method defined in claim 4, wherein the back panel and the peripheral side wall form a recess that receives the electronic device.

6. The method defined in claim 5, wherein the back panel has interior and exterior surfaces, wherein the interior surface faces the electronic device with the electronic device is within the recess, and wherein the knit representation of the user-selected digital image is located on the exterior surface of the back panel.

7. The method defined in claim 4, wherein the peripheral side wall comprises a knit peripheral side wall that is attached to the back panel with a seam.

8. The method defined in claim 4, further comprising:

with the computing equipment, reducing a resolution and a number of colors in the user-selected digital image.

9. The method defined in claim 8 wherein reducing the resolution of the user-selected digital image comprises reducing the resolution of the user-selected digital image to 120 pixels by 64 pixels.

10. The method defined in claim 8 wherein reducing the number of colors in the user-selected digital image comprises reducing the number of colors in the user-selected digital image to six colors.

11. The method defined in claim 1 wherein the user-selected digital image comprises a photograph.

12. A method for forming a fabric case for an electronic device, comprising:

with computing equipment, receiving a digital photograph from a user of the electronic device;

with the computing equipment, converting the digital photograph into a textile machine file; and with knitting equipment, using the textile machine file to knit a back panel of the fabric case with a knit image of the digital photograph, wherein the knit image is formed from an array of loops of at least three different colors.

13. The method defined in claim 12, further comprising:

with the computing equipment, reducing a resolution and a number of colors in the digital photograph.

14. The method defined in claim 12, further comprising:

knitting side walls and attaching the side walls to the back panel.

15. The method defined in claim 12 wherein the back panel has an outer surface that faces the exterior of the fabric case and wherein the knit image is located on the outer surface.

16. The method defined in claim 12 wherein the fabric case is configured to receive the electronic device without covering a display of the electronic device.

17. A fabric case for an electronic device comprising:

a back panel having a periphery with four sides, wherein the back panel comprises a knit image of a user-selected digital photograph, wherein the knit image is formed from loops of colored yarn, and wherein the colored yarn that forms the knit image comprises six different colors of yarn; and a side wall that extends around all of the four sides of the periphery, wherein the back panel and the side wall form a recess that receives the electronic device, wherein the back panel has opposing interior and exterior surfaces, wherein the interior surface faces the electronic device when the electronic device is within the recess, and wherein the knit image is on the exterior surface of the back panel.

18. The fabric case defined in claim 17 wherein the knit image has a lower resolution and fewer colors than the user-selected digital photograph.

19. The fabric case defined in claim 17 wherein each loop of yarn represents a pixel in the knit image, and wherein the resolution of the knit image is at least 120 pixels by 64 pixels.

* * * * *